United States Patent [19]

Block

[11] Patent Number: 4,718,158

[45] Date of Patent: Jan. 12, 1988

[54] AUTOMATIC TAGGING APPARATUS AND METHOD THEREFOR

[76] Inventor: Charles Block, 1129 Albert Rd., No. Bellmore, N.Y. 11710

[21] Appl. No.: 710,510

[22] Filed: Mar. 11, 1985

[51] Int. Cl.[4] ..... B65C 7/00

[52] U.S. Cl. ..... 29/432; 227/67; 227/152; 227/153

[58] Field of Search ..... 227/67, 151, 152, 153; 29/432

[56] References Cited

U.S. PATENT DOCUMENTS

| | | | |
|---|---|---|---|
| 3,598,025 | 8/1971 | Cotton | 227/67 X |
| 3,734,375 | 5/1973 | Bone et al. | 227/67 |
| 3,735,908 | 5/1973 | Kinney et al. | 227/67 |
| 3,896,713 | 7/1975 | Mato | 493/38 |
| 3,985,067 | 10/1976 | Livio et al. | 227/67 X |
| 4,237,779 | 12/1980 | Kunreuther | 493/376 |
| 4,315,587 | 2/1982 | Ritter et al. | 227/152 X |
| 4,323,183 | 4/1982 | Duchin | 227/67 X |
| 4,610,385 | 9/1986 | Duchin | 227/67 |

*Primary Examiner*—Howard N. Goldberg
*Assistant Examiner*—Taylor J. Ross
*Attorney, Agent, or Firm*—Jerome Bauer; Murray Schaffer

[57] ABSTRACT

A method and apparatus for automatically tagging selected layers of multi-layered articles by the operation of a single switch that initiates the sequential stepped operation of a clamp for holding the selected layers in a tagging position while a tag is fed and tacked, as by a bar tack, to join the tag to the selected layers. When the tagging sequence is completed, the article is removed from the apparatus, thereby separating the joined bar tack and tag from the apparatus for similar subsequent automatic repetitive operations.

20 Claims, 14 Drawing Figures

AUTOMATIC TAGGING APPARATUS AND METHOD THEREFOR

BACKGROUND OF THE INVENTION

The present invention relates to an apparatus for automatically applying tags to single or multi-layered articles including, without limitation, articles of wear made of fabric, leather and other materials that can be penetrated by tacks or bar locks of the type as is generally disclosed in Bone U.S. Pat. No. 3,103,666. The term "track" as used herein is intended to include all types of fastening means and is not intended to be limited to bar shaped tacks or lock-type fasteners. Hence, it is to be understood that references to "tack" and illustrations of a bar lock are not intended to be a limitation upon the scope of the invention. Additionally, the tack may be applied to and through articles other than fabric as, but not limited to, plastic wrappers, cardboard, etc.

In the past, it has been the practice to apply tags, such as price tags, identification tags and the like, to layered articles by the use of tacks or fasteners, as bar locks at the place or point of sale thereof which was generally the store from which the article was sold. Usually the price tags were marked with the selling price of the article when the article was first placed on display by the store. Hence, it was convenient for the store to apply its own tags to the articles. Oftentimes these tags were applied by hand in a hand held device of the kind disclosed in the Bone Patent which dispensed the tacks or bar locks.

When it became necessary to change the prices of the already tagged articles, the tacks or bar locks were cut free of the article to remove the same. After the old price tag was then removed and discarded, it was then necessary to prepare a new price tag and to tack or fasten the same to the article. To do this, a new bar lock or tack had to be applied to the article with the hand operated tag attaching apparatus of the type that is generally of the kind disclosed in the aforementioned patent to Bone.

The process of removing the old tag and applying a new tag and joining bar lock was laborious, time consuming, expensive and at times it was difficult to apply the bar lock or tack to just one ply or one layer of the multi-layered article. It frequently happened that when the new bar lock and tag was tacked to a multi-layered article, the tack or bar lock would be applied through more than just one ply or layer of the article. This resulted in locking or tacking closed the opening of the article, such as the neck of a shirt, or the sleeve of a suit or a coat, or the waist of a skirt and even the openings of a pair of gloves, which prevented the same from being opened fully and tried on by a prospective customer.

Moreover, the hand held apparatuses for applying the tacks or bar locks had a very limited capacity of bar locks that they could hold and dispense in a given period of use. Hence, it was necessary for the user of the apparatus to stop frequently to refill the apparatus with additional supplies of bar locks, much in the same manner as it is necessary to resupply hand operated staplers with strips of staples. Also, hand held aparatuses are prone to accidental stabbing of the hand of the user holding the garment by the needle of the hand held tool.

SUMMARY OF THE INVENTION

The present invention teaches the use of a stationary automatic tagging apparatus that may be operated quickly and easily with an almost limitless supply of interconnected tacks or bar locks. Although the present invention applies the tacks and tags to the articles for much the same purposes as before, it does so automatically requiring the operator to do nothing more than to activate the tagging apparatus when the desired portion of a selected one or more plies or layers of the multi-layered article to be tagged is properly positioned within the apparatus. Thereafter, the tagging apparatus performs its operation automatically requiring only that the operator initiate the operating means to start the automatic sequence of tagging steps.

To this end, the present tagging apparatus is provided with a tag dispensing magazine from which a single tag is fed, one at a time from a stack of many tags into a tagging position on a support table. Each tag is generally provided with a tag hole and the tag dispensing magazine is adjustable so that the tag hole can be predeterminately fed to a desired tagging position in line with a tack feeding needle that applies the tack through the tag hole to join the tag to the selected ply or layer of the multi-layered article positioned therebeneath. In those instances when the tag is provided without a hole, the tag will be pierced by the needle which will feed a tack through it. A magazine or roll of connected tacks is supplied to the tack feeder needle to provide an almost endless supply of tacks for extended periods of operation.

A clamping anvil having a support surface for supporting a selected one or more plies or layers of the article to be tagged is relatively movable with respect to a table to clamp the selected plies or layers of the article beneath the tag and tack feeder to hold the same in the desired tagging position. The anvil enables the proper application of the selected plies or layers of the article to be predeterminately located against an adjustable stop for proper positioning of the selected plies or layers to the desired tagging position.

The operation of the anvil clamps the selected layers to the table against movement relative to the tag during the application of the tack through the tag hole and through the selected plies or layers. Thereafter, the anvil is operated to release the tagged article. Immediately prior to the release of the tagged article, the tack feeding needle is withdrawn. The withdrawal movement of the track feeding needle and the removal of the article from the apparatus after it has been tagged completely separates the joining tack from the remaining supply of tacks. This enables the needle to return empty to its feeding position to receive a new tack for a subsequent tagging operation.

Although the operating system is shown to be pneumatically controlled, it will be clear from a description of the invention that the same is not so limited. The present apparatus may be controlled mechanically, electrically, hydraulically or by any combination of such mechanisms.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

Figure 7:
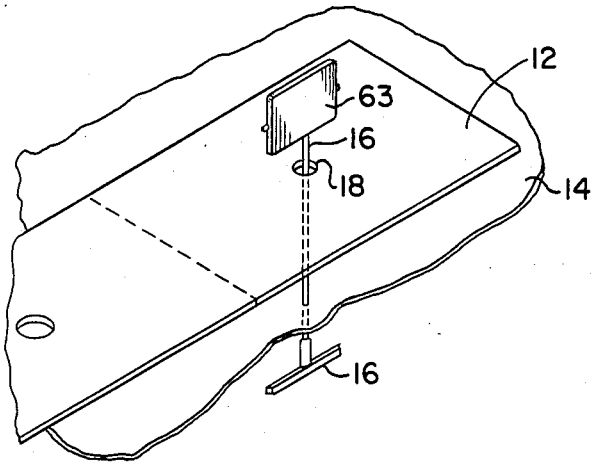
FIG. 7 is a perspective view showing a tack or bar lock of FIG. 6 joining a tag to a selected layer or ply of an article.

Referring now to the drawings, the tag apparatus thereshown is generally identified by the numeral 10. The apparatus 10 is intended to operate automatically once it is initiated by the operator to produce the end result of a tag 12 as shown in FIG. 7 joined to a selected ply or layer 14 of a desired article 15 by a fastener or tack in the form of a bar tack 16 which joins together the tag 12 and the selected layer 14 by passing through a tagging hole 18 provided in the tag 12. The article 15 may be of any single or multi-layered construction such as a pair of trousers, a skirt, a necktie, a pair of gloves or the like as can be more clearly seen in FIGS. 8 to 13.

The apparatus 10 includes a base 20 that has mounted thereon a clamping anvil 22 pivotted to the base as at 23 for relative movement with respect to the underside of a table 24. The clamp or anvil 22 is actuated by a cylinder 25 that may be conveniently mounted on the base 20 and which is controlled in its operation by an operating structure to be described. A resilient pad 27, applied either to the underside of the table 24 or to the anvil clamp 22, increases the frictional engagement with the layer 14 positioned therebetween.

Figure 1:
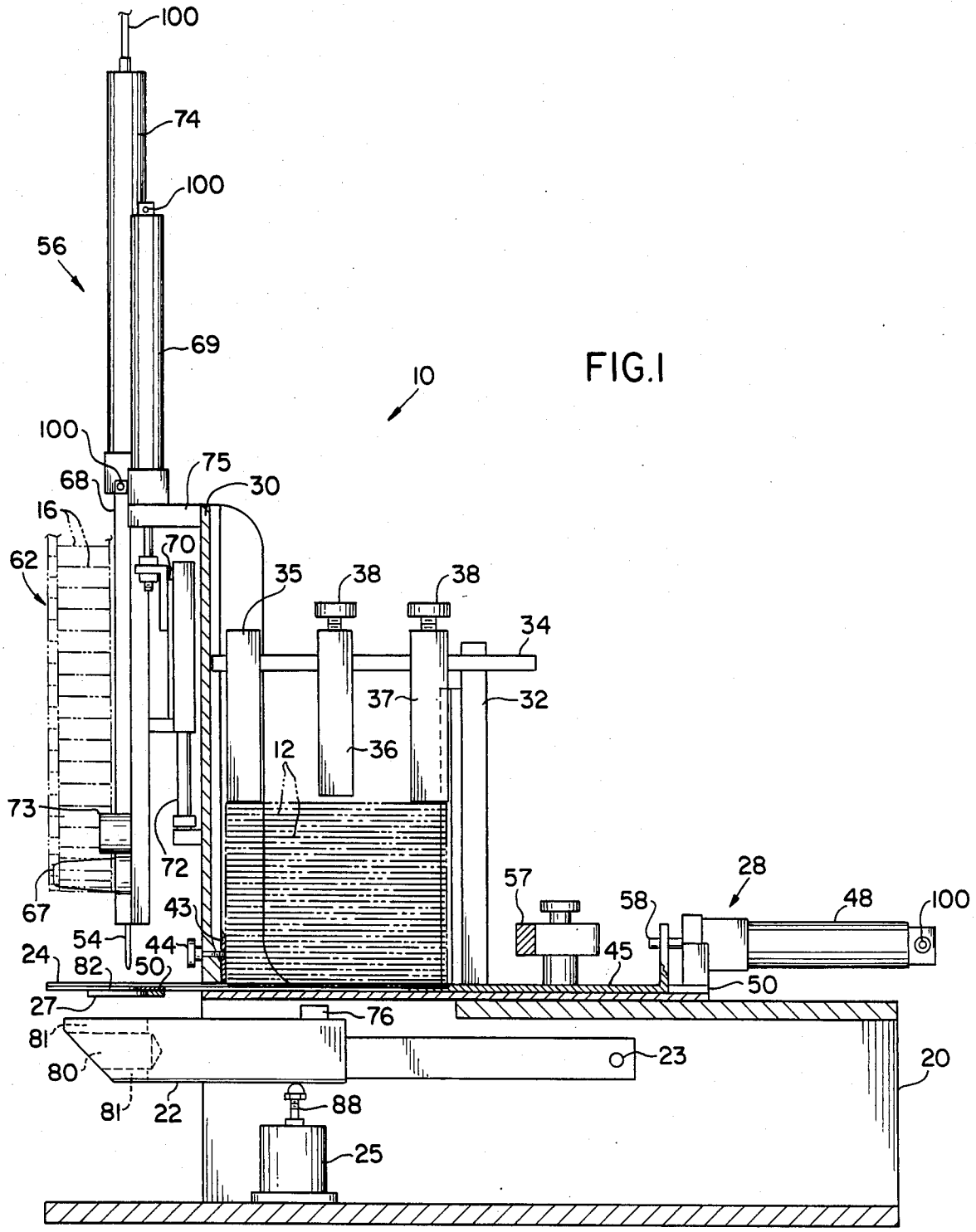
FIG. 1 is a side elevation of the tagging apparatus constructed in accordance with the teaching of the present invention.

The table 24 is intended to support a supply of tags 12 that are stacked in magazine form above the table surface. The tags 12 are retained within a tag feeder mechanism generally identified by the numeral 28 that can be seen more clearly in FIGS. 1, 3 and 4. The tag feeder mechanism 28 will accommodate tags of varying lengths, widths and thickness by reason of the adjustments that may be made to the mechanism details. Thus, the tag feeder mechanism 28 includes a front wall 30 and a relatively movable rear wall 32.

The front wall 30 is mounted on the base 20 and functions as a support standard for the details of the tag feeder mechanism. It includes a vertical guide slot 33 defined in the rear face thereof. A similar guide slot 33 is also provided in the relatively movable rear wall 32. The guide slot 33 permits the receipt and accomamodation of a cross bar 34 therein. The cross bar 34 supports a series of relatively spaced weights 35, 36 and 37 that are suspended on the bar each independently therefrom. Each of the weights is freely rotatable and pivotally mountable on the cross bar 34 so that they may seek their own center of gravity.

The front weight 35 is positioned adjacent to the rear surface of the front wall 30 so as to bear upon the topmost leading portion of the topmost tag 12 in the stack or magazine. The rear weight 37 bears upon the rearmost portion of the stack of tags 12 in the magazine while the middle weight 36 is interposed intermediate the front and rear weights to overlie the central portion of the stack which normally has a tendency to bow upward during the feeding of the lowermost tag 12 from the stack. Hence, the more centrally located weight 36 limits the upward bowing movement of the stack of tags 12 in the magazine during the feeding of the lowermost tag therefrom.

The weights 36 and 37 are adjustable along the length of the cross bar 34 to assure their proper positioning over the stack of tags 12. They may be located or fixed in their desired positions above the stack of tags 12 by the tightening of set screws 38 mounted in each of them. Because the cross bar 34 slides freely in the guide slots 33, the weights are permitted to apply their weight to the top of the stack of tags 12 even as the tags are removed therefrom without regard as to how many tags remain in the stack.

Figure 3:
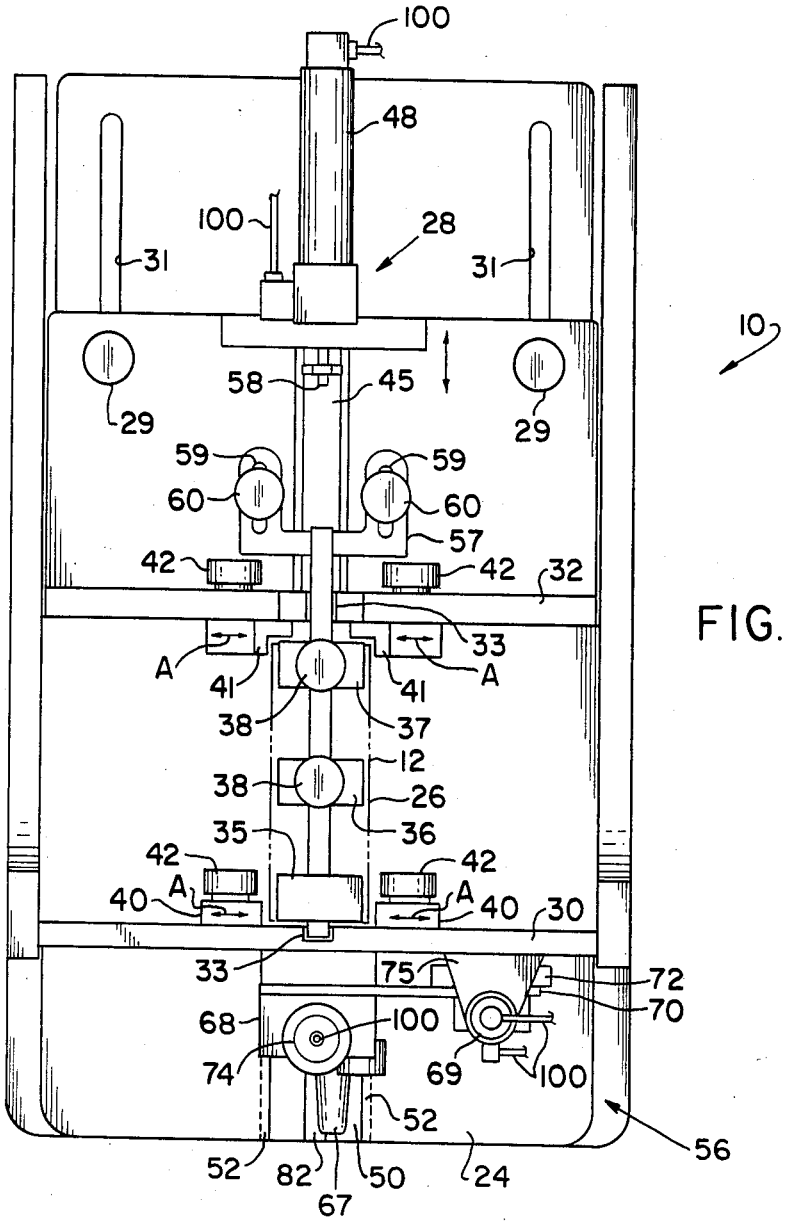
FIG. 3 is a plan view.

The stack of tags 12 is properly positioned on the upper surface of the table 24 by relatively laterally spaced front guides 40 and relatively laterally spaced rear guides 41 each of which is adapted to be adjusted in lateral directions as indicated by the arrows A in FIG. 3 by the manual operation of adjustment screws 42 or the like thereon. When once the screws 42 are set and tightened, the respective guides 40 and 41 are secured in their relative positions to support the stack of tags 12 therebetween. The lengths of different sized stacks of tags may be accommodated by adjusting the whole assembly by thumb screws 29 in slots 31 therebeneath. The rear wall 32 may be moved relative to the front wall 30 also by tightening and untightening the screws 42 or the like of the guides 41 to unlock the rear wall 42 for adjustment and to relock it in its adjusted position.

Figure 4:
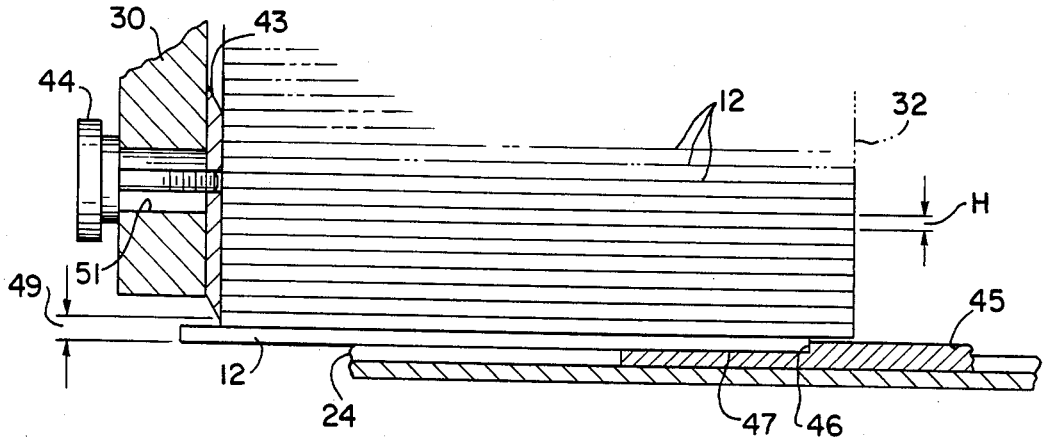
FIG. 4 is an enlarged view of the tag feeder.

The tag feeder means or mechanism 28 is positioned beneath the stack of tags 12. The tag feeder includes a tag feeder element 45 that is slidable along the table 24 beneath the stack of tags. The element 45 is shown in greater detail in FIG. 4. Referring to FIG. 4 there is an illustration of the stack of tags 12 positioned in the magazine. Each tag is of substantially uniform height as indicated by the letter H.

To enable the tag feeder element 45 to pick but a single tag at a time from the bottom of the stack 26, the feeder element 45 is provided with a feeder abutment surface 46 that is shallower in height than the height H of each of the tags above it. The abutment surface 46 is formed by reducing the height of the feeder element 45 so as to leave a tag support feeding surface 47 at the leading end of the feeder element 45. The abutment height 46 is less than the height H of the tags 12 because the remaining height of the element 45 above the abutment surface 46 is slightly below the height H of the tag 12 to be fed by the element 45.

The base of the front wall 30 is raised above the table 24 sufficient to permit thicker tags to be moved therebeneath, but is provided with two relatively spaced picker or throat knives 43 that are vertically adjustable within vertical slots defined in the rear surface thereof adjacent the leading edge of the stack of tags 12. The lower edges of the knives 43 are adjustable at a height 49 by thumb screws 44 accessible through and guided by apertures 51 in the wall 30. The height of their adjustment is greater than the height H of the lowermost tag 12 but less than the height of two lowermost tags to thereby assure that only the lowermost tag can be fed beneath the wall 30 by the feeder element 45.

Figure 2:
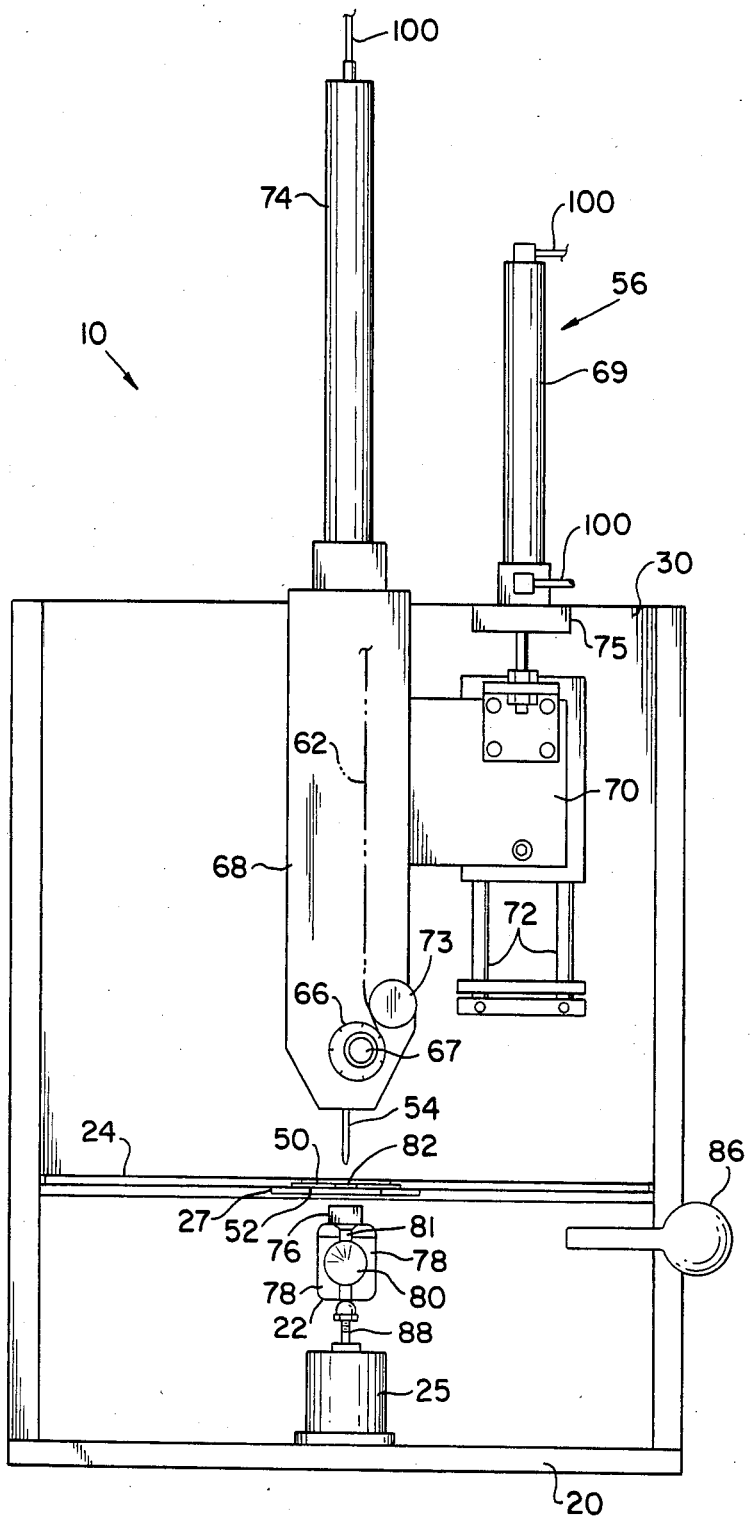
FIG. 2 is a front view.

The feeder element 45 is connected with an operating means in the form of a cylinder 48 that is connected with a pneumatic source controlled by an operating means or mechanism to be described. The feeder element 45 slides on the tag support table 24 to abut and push the lowermost tag 12 to remove it from the stack thereabove. In order to effectively and precisely guide the movement of the lowermost tag 12 from the stack thereabove, the table 24 and the feeder element 45 have cooperating guide surfaces. As illustrated in FIG. 2, the table 24 is provided with a substantially T-shaped slot 50 in which the tag feeder element 45 is slidably guided during its movement by its operating means 48.

The slot 50 is narrower at its upper portion and wider at its lower portion. Its narrower lower portion accommodates the width of the tag feeder element 45 which fits slidingly therewithin. Its wider portion accommodates the width of a fed tag 12 that is separated from the stack by the feeder element 45. Thus, the feeder element 45 is smoothly and accurately guided during its movement beneath the stack to remove a tag 12 therefrom and to feed the lowermost tag 12 between and along the wider width and shoulders 52 of the feeder slot 50. The tag is fed to a desired tagging position on the table 24 wherein its hole 18 is positioned below and in alignment with a tack feeding needle 54 of the tack feeding mechanism 56 immediately thereabove. In those instances when the tag 12 is not provided with a hole 18, the location 18 designates the tagging portion of the tag to be fed to the desired tagging position on the table 24.

In order to be able to accurately feed and position the tag hole or tagging portion 18 into its desired tagging position on the table 24 in alignment beneath the tack feeding needle 54 there is provided a stop member 57 mounted on the base 20. The stop member 57 functions as an abutment for the shaft 58 of the operating cylinder 48. By adjusting the abutment 57 by way of the cooperation of the slots 59 and adjusting screws 60 mounted on the base 20, it is possible to position the member 57 so as to provide an abutment for the operating cylinder shaft 58 to thereby prevent or limit the feeding movement of such shaft and hence the feeding movement of the tag feeder element 45. This assures that the hole or tagging portion 18 of the tag 12 fed by the element 45 will always be fed into alignment with the tack feeder needle 54 thereabove. The length of the table 24 beneath the needle 54 will be sufficient to assure that the tag will be properly supported beneath the needle 54 during the tagging operation to be described.

Figure 6:
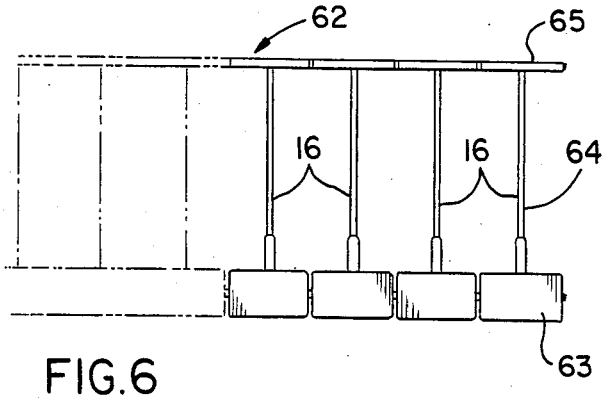
FIG. 6 is a plan view of a partial length of fastener tacks or bar locks.
Figure 5:
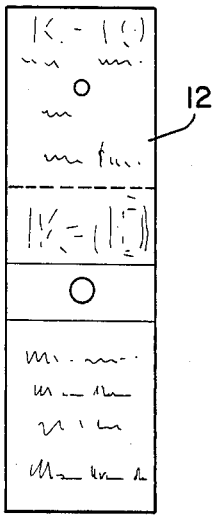
FIG. 5 is a plan view of a tag.

The needle 54 forms a part of the fastener or tack feeding drive mechanism 56 which includes a supply of tacks 16 illustrated in FIGS. 6 and 7 in the form of bar tacks or bar locks. The tacks 16 are formed in a continuous long roll generally identified by the numeral 62 with each of the bar tack elements 16 interconnected alaong their sides to each other next adjacent tack in the roll by a frangible connector. Construction of the roll of tacks is already well known and forms no specific part of the invention except that it is now possible to use almost endless continuous rolls of the joined bar tacks in the present apparatus so as to enable the apparatus to function for long periods of time without reloading it with new rolls of interconnected tacks 16.

FIG. 6 illustrates the arrangement and interconnection of the tacks 16 with each other. The tacks 16 are generally formed with an enlarged head or button 63 at one end connected with an elongated narrow body 64 which terminates at its other end in connection with a narrow cross arm or transverse bar 65. The construction of the tack 16 as described is more fully detailed in the patent to Bone U.S. Pat. No. 3,103,666 previously referred. The manner in which the tack 16 is used and joined to a tag 12 by the tack feeding needle 54 is also more clearly and fully disclosed in the Bone patent.

The continuous roll 62 of interconnected fastener tacks 16 is fed to an indexing roller 66 which has positioned about its periphery a series of relatively circumferentially spaced slots for receiving the body 64 of a series of tacks 16 therein. The endmost tack 16 on the length of the continuous roll of tacks 62 is positioned adjacent to an opening in the needle 54 that is contained within a housing 68 of a fastener or tack needle drive mechanism which includes an operating means in the form of a pneumatic cylinder 69.

Operation of the cylinder 69 actuates the housing 68 and the needle 54 by way of the arm 70 to reciprocate the same between their raised inoperative position and their lowered or downward operative position. After lowering down the housing 68 and needle 54 to pierce through the tag hole or tagging portion 18 of the tag 12 that is in the tagging position, and through the layer 14 and into the protective confines of the anvil 22, the needle is then ready to receive the bar 65 of the tack 16.

The transverse bar 65 and the body 64 of the tack 16 are bent into aligned relationship with each other as disclosed in the Bone Patent and illustrated in FIG. 2 thereof. The transverse bar 65 is driven into the hollow of the needle 54 by an ejector pin as disclosed in the Bone patent that is controlled automatically in its reciprocating movements by a pneumatically operated cylinder 74 forming a part of the tack feeding mechanism 56. The details of the ejector pin and the operation of the same within the housing 68 of the tack feeding mechanism of the present invention form no part of the invention. Hence, the adequate disclosure of the operation of the same in the Bone patent avoids the necessity of repeating an explanation of the same herein. Although the tacks 16 are fed automatically to their tack feeding position by a mechanism 73 to aid in the initial introduction of the endmost tack 16 into the receiving and feeding needle 54, the indexing roller 66 is provided with a manually rotatable knob 67 easily accessible on the front thereof.

The arm 70 for transmitting the operation of the cylinder 69 to the housing 68 and needle 54 is guided in its sliding movement on a pair of relatively spaced guide bars 72 during its reciprocating movement and actuation. The housing 68 and the arm 70 along with the guide bars 72 all are mounted on the front surface of the apparatus 10 by a forward projecting support 75 which is connected in turn with the front wall 30 and the base 20.

Provided on the clamping anvil 22 conveniently below the table is an article abutment positioning means 76 which is adjustable in any conventional manner (not shown) along the length of the clamping anvil member 22. It is possible to insert a selected layer 14 of an article 15 onto the top of the clamping anvil below the relatively movable tag table 24 against the adjusted abutment 76 so as to position a desired portion of the layer 14 of the article 15 directly beneath the tack feeding needle 54 so that only the desired portion of the selected layer 14 of the article 15 may be tagged in the manner to be described.

The clamping anvil member 22 is provided with a pair of opposed, relatively spaced, elongated bordering side walls 78 as can be seen more clearly in FIG. 2 which have formed between them an enlarged tack receiving opening 80. A vertical opening 81 is directly aligned with the tack feeding needle 54 to receive the same therein and to accommodate the passage of the transverse bar 65 of the tack 16 in the protected opening 80. The front portion of the tag supporting table 24 may be provided with an elongated slot 82 so as to permit the removal of the tagged article from between the front of the clamping anvil and the table 24 after the tag has been applied to the layer 12 by the fastening tack 16 in a manner to be described.

Figure 8:
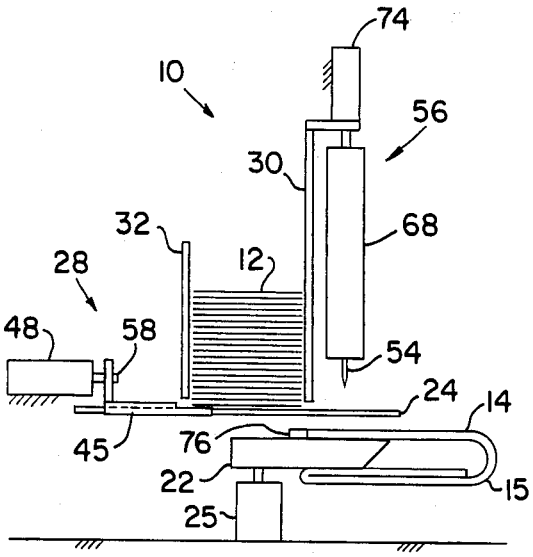
FIGS. 8 to 13 are views of the automatic operating steps of the tagging apparatus.

The sequential operation of the apparatus 10 is more clearly illustrated in the diagrammatic views of FIGS. 8 through 13 inclusive. FIG. 8 illustrates the anvil 22 in its initial open unclamped, normally inoperative position wherein it and the table 24 thereabove are normally relatively spaced from each other. This initial relative spacing between the anvil and the table provides the operator with frontal access to the desired tagging position to easily and rapidly insert the selected layer 14 of a multi-layered article 15 into the apparatus in the space between the clamping anvil and the table. When the selected layer 14 is located against the abutment 76, its further insertion into the apparatus is halted thereby indicating to the operator that it is in the desired tagging position. This contemplates the prior adjustment of the abutment 76 so as to assure the placement of the selected layer 14 in such desired tagging position.

As can be seen from FIG. 8, the tack feeder needle 54 is withdrawn and in its upward raised position. The layer 14 of the article 15 is located in the desired tagging position on the anvil against the adjusted positioning stop 76. The ejector or driving pin (not shown) for feeding a tack 16 to the needle 54 is similarly retracted by its operating means 74 which is in its raised position. The stack or supply of tags 12 is inactive with the tag feeder element 45 in its retracted rearward position with only a portion of its tag support surface 47 positioned beneath the lowermost tag to be fed from the stack thereabove.

Provided on the front of the apparatus 10 is a start button 86 that is readily accessible to the operator for depression after one or more of the selected layers 14 of the multi-layered article 15 is placed upon the anvil against the abutment 76. The apparatus 10, with the selected layer 14 in the desired tagging position on the anvil 22, is now ready to be operated. All that is necessary is for the operator to depress the start button 86 to initiate the automatic operation of the apparatus 10.

Figure 14:
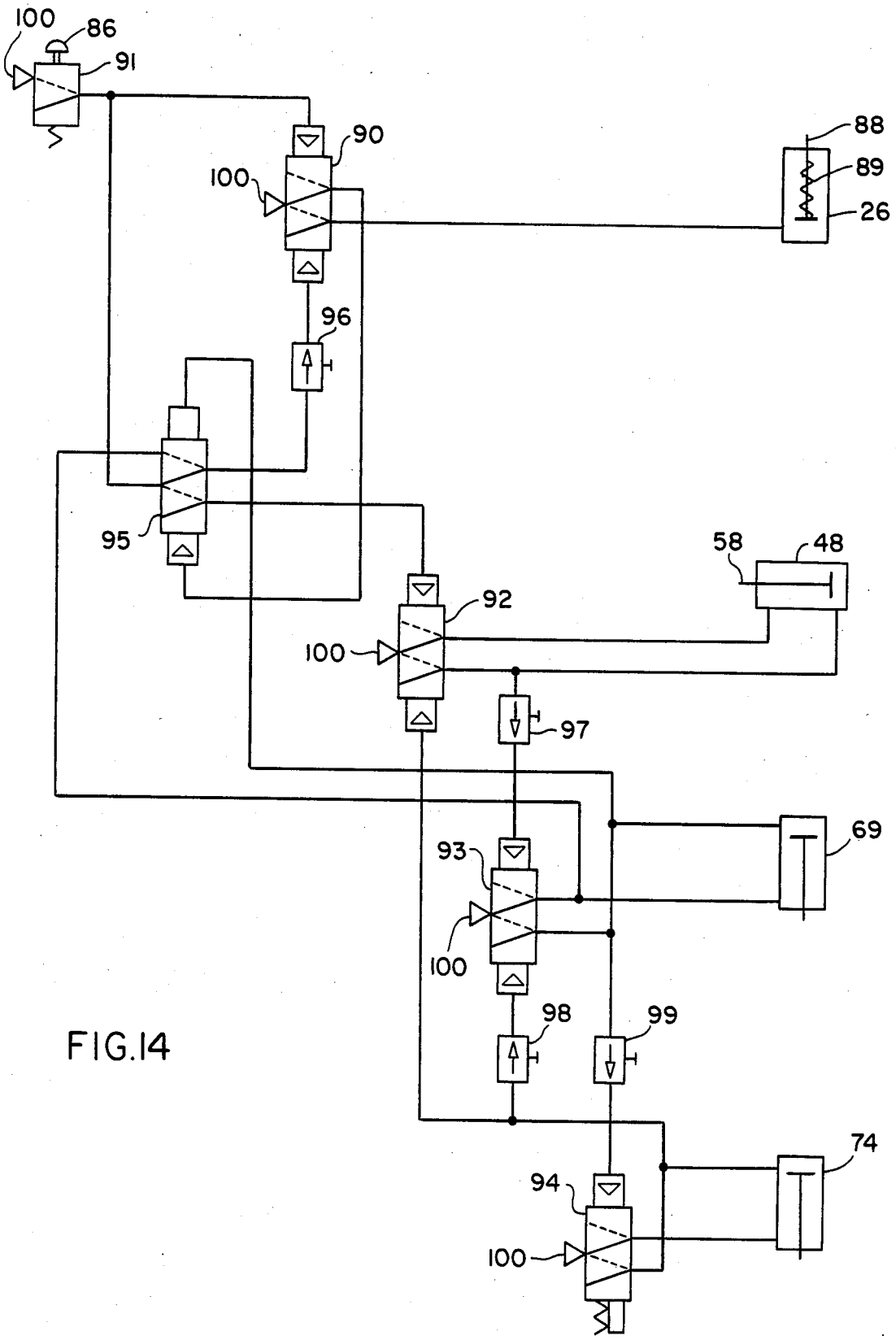
FIG. 14 is a diagrammatic view of the automatic operating system of the tagging apparatus.

Reference may now be made to the schematic drawing of FIG. 14. It will be seen that the operating means 25 includes a shaft 88 about which there is a return spring 89 which normally biases the operating shaft 88 downward. This enables the clamping anvil 22 to move away from the table 24 to assume their normally spaced relationship. The cylinder 25 is connected with a double acting fluid relay valve 90. The fluid relay valve 90 is in turn connected with a double acting fluid valve 91 that is operated by the depression of the start button 86. Both valves 90 and 91 are in turn connected with a double acting relay valve 92 of the tag feeder cylinder 48. A shifting double acting relay valve 93 controls the fastener gun drive or operating cylinder 69 which controls the operation of the tack feeder needle 54.

The double acting valve 94 is connected, in turn, to control the operation of the operating cylinder 74 of the internal tack feeder (not shown) contained in housing 68 and as disclosed in the Bone Patent. Valve 95 is connected between the valves 90, 92, 93 and 94 for a purpose to be described. Interposed in the line between the valve 90 and 95 is a timer 96. Similarly timers 97, 98 and 99 are interposed between the valves 92, 93 and 94.

The valves 90, 91, 92, 93 and 94 are each connected with a source of pneumatic power at the connecting points 100. As the description proceeds, it will be clear that the disclosed use of pneumatic energy to operate the system should not constitute a limitation upon the scope of the present invention. Those skilled in the art will recognize the present invention may be operated hydraulically, electrically or mechanically or by any combination of the same if so desired. It has been found that most factories have an inexpensive supply of compressed air. Therefore, the present invention has been disclosed and made to operate with compressed air.

When the start button 86 is depressed, the depression need be only momentary to cause the relay valve 91 to shift to thereby supply fluid power to the valve 90. Fluid supplied to the valve 90 causes the positive movement and actuation of the shaft 88 against the normal resistance and opposite urging of the spring 89 in the cylinder 25 to raise the anvil 22 to thereby cause a relative movement between the table 24 and the anvil 22 to clamp the selected layer 14 of the multi-layered article 15 between the table and the anvil. Although the anvil is disclosed as being the member that is moved to clamp the selected layer 14, it will be clear to those skilled in the art that the table 24 could be moved with equal ease or that both the anvil and the table could be moved jointly into clamping relationship.

Figure 9:
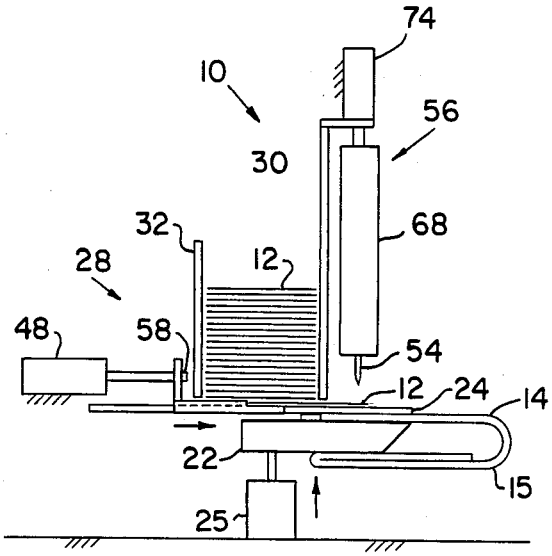

At the same time that the anvil 22 clamps the layer 14 with the table 24, the relay valve 92 also is caused to shift. This activates the tag feeder operating means or cylinder 48 to move the shaft 58 thereby moving the tag feeder 45. When the tag feeder mechanism abuts the lowermost tag 12 in the stack as is shown in FIG. 9, the abutment surface 46 feeds the tagging portion 18 of the tag to the desired tagging position on the table 24 beneath and into alignment with the tack feeding needle 54. The operation of the valve 90 also initiates the timer 97. It will be noted that each of the timers 96, 97, 98 and 99 is provided with adjustment means to vary the operation of each timer thereby to control the period of operation of each of the valve associated therewith.

As the timer 97 completes its timing cycle, it shifts the relay valve 93 which in turn causes the shifting of the relay valve 95 to initiate the presetting operation of the valve 90. The operation of the valve 95 initiates the extending movement of the operating cylinder 69 to drive downward the housing 68 to extend and move the tack feeder needle 54 at the bottom thereon downward through the hole or the tagging portion 18 in the tag 12 positioned in alignment therewith and downward through the opening in the table 24 and further downward through the selected clamped layer 14 and the portion thereof that is clamped in the desired tagging position. The tack feeder needle 54 continues to move completely through the layer 14 of the article 15 as is shown in FIG. 10 to its final bottom position with the anvil 22.

Figure 10:
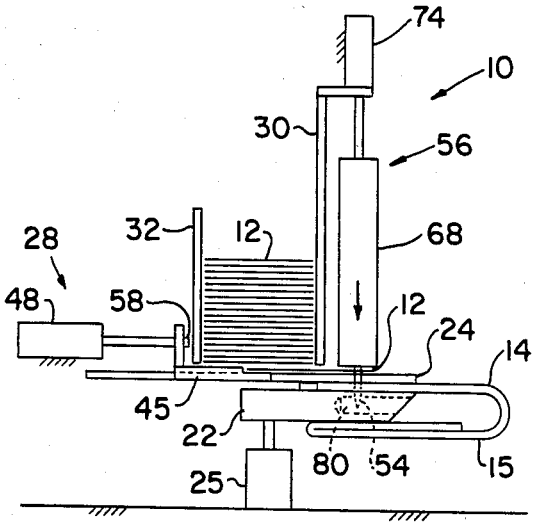

During this operation, it will be noted from FIG. 10 that the tag feeder element 45 remains in the tag feeding position to assure that the tag is properly held in its tagging position during the tagging operation. The timer 99 is initiated by the operation of the tack feeder cylinder 69. As it completes its timing cycle it shifts the relay 94 to move the piston shaft of the piston 74 to move the tack ejector pin (not shown) in housing 68 to insert into the needle 54 the transverse bar 65, with the body 64 of the tack 16 paralleling the bar 65. Continued movement of the shaft of piston 74 ejects the bar 65 from the needle, through the layer 14 and into the opening 80 of the anvil 22. This drives tack 16 that is in the needle 54 outward therefrom and through the aligned hole or tagging portion 18 in the tag 12 therebeneath in the desired tagging position, and also through the portion of the selected layer 14 of the work piece or article 15 that is in the desired tagging position. This signals the timer 98 to operate.

Figure 11:
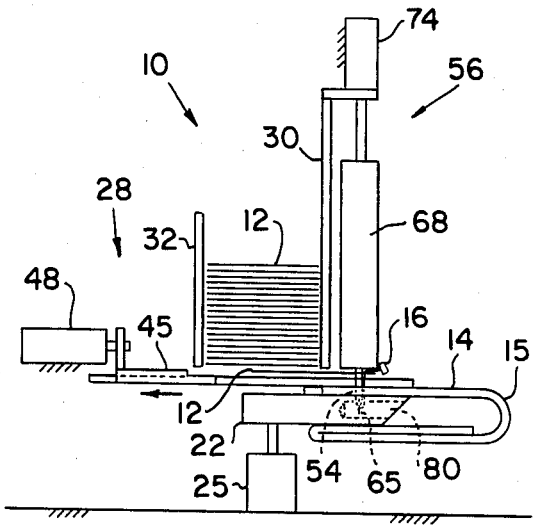

The operation thus described is illustrated diagrammatically in FIG. 11 wherein it will be seen that the transverse bar 65 of the tack 16 has passed completely through the tagging portion 18 in the tag 12, the table 24, the clamped layer 14 and into the enlarged opening 80 of the anvil 22. During the extension of the shaft of the piston 74 to operate the pin ejector mechanism, the tag feeder cylinder 48 is operated to withdraw its shaft 58 and the tag feeder element 45 from the tag feeding position.

Figure 12:
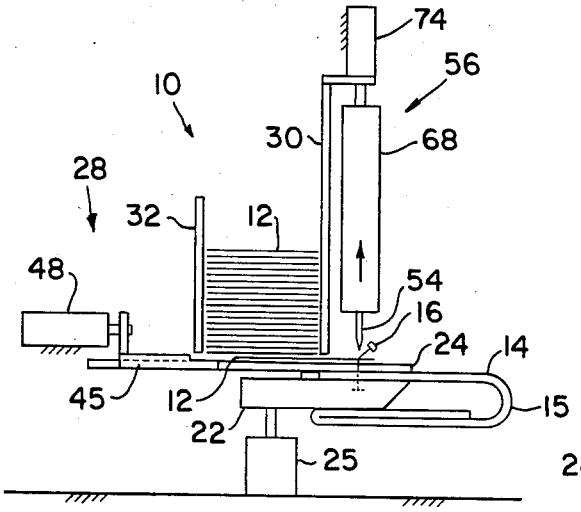

As the timer 98 completes its timing cycle, it resets the valve 93. This causes the tack feeder drive cylinder 69 to raise and withdraw the housing 68 and the needle 56 from its operating position as shown in FIG. 11 to the position as shown in FIG. 12. At this time the relay valve 94 also resets retracting the pin ejector piston in the cylinder 74. During this retraction an internal mechanism in the housing 68 feeds a new tack 16 to feeding position. Such mechanism is not shown because it is fully described in the aforementioned patent to Bone. As a result, the timer 96 is started by way of the relay valve 95 which was preset previously and the apparatus 10 returns to the condition as is illustrated in FIG. 12.

When the timer 96 completes its operation, it resets the relay valve 90 which retracts the anvil cylinder shaft 88 to thereby resume the normal spaced relationship of the anvil and the tag table from each other. This resets the valve 95 which shuts off the timer 96 and automatically returns the apparatus 10 for a new series of automatic stepped operations.

Figure 13:
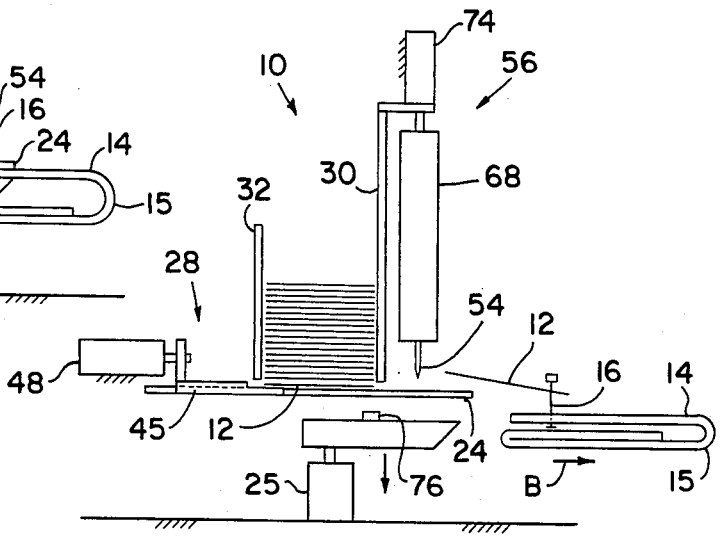

After the anvil 22 and the table 24 are returned to their normal relatively spaced relationship, the previously clamped selected layer 14 of the multi-layered article 15 is now released from the apparatus. Thereafter the article 15 is moved in the direction of the arrow B as shown in FIG. 13 to remove the article from the apparatus with the tag 12 joined to the same by the tack 16 as is thereshown.

The smaller transverse bar 65 of the tack 16 is separated from the transverse bar 65 of the next adjacent tack of the supply 62 when the tack is fed into the needle. When the article 15 is subsequently removed from the apparatus 10 as is shown in FIG. 13, the button 63 that had remained attached to the button 63 of the next adjacent tack 16, still forming a part of the supply 62, is separated therefrom merely as a result of the slight tugging action that is applied to the article 15 when removing it from the apparatus 10.

In the manual application in the past of bar tacks to articles such as the layered article 15 by the use of hand operated tagging devices of the type shown in the Bone patent, the needle came into undesired perforating contact with other layers of the article. As a result, damage to the article frequently occurred during the tagging operation. This resulted in the damage to and loss of valuable articles and large sums of money in the event the articles being tagged have great value. In addition damage to the operator by piercing and breaking needles was and is common. The present invention fully protects the operator from injury and to all of the layers of the article 15 from contact with the needle, other than the one selected layer 14 to which the tag is to be joined by the tack fastener 16.

This is done by providing the clamping anvil 22 with the protective bordering side walls 78 which extend for the full distance downward along the sides of the needle 54 after the needle penetrates completely through the selected layer 14 of the article 15. This assures that the needle 54 is fully encompassed within the anvil and that no portion of the needle can come into damaging contact with any other portion of the article 15 or the operator. Thus, the article and the operator are completely protected from contact and damaging engagement with the needle 54.

It will also be noted that by making the apparatus 10 accessible to the operator through the front thereof, the apparatus may be used quickly, safely and with great ease. It avoids the necessity of the operator to twist or turn or to peer behind corners or in back of operating mechanisms in order to assure that the tag is joined to the desired portion of the selected layer 14 of the article 15. Even with the use of hand held tagging guns of the type exemplified by the Bone patent, the device itself obscures from the operator's view the tagging operation thereby making it difficult at times for the operator to be able to see the operation of the mechanism and to assure that the tag is being joined to only that desired portion of the layer 14 to which it must be applied.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An apparatus for tagging selected layers of an article comprising a table having tagging positions thereon;

a supply of tags each of which has a tagging portion;

means to feed the tag portion of a tag from said tag supply to said tagging position on said table;

a supply of tacks for joining to selected layers of an article and a tag with its tagging portion in said tagging position;

means to clamp against said table selected layers of an article to be tagged that are in said tagging position below said table;

means to locate the selected layers of an article in said tagging position below said table and between said table and said clamp;

and means feeding a tack from said supply of tacks to pass at least partially through said tagging portion in said tag in said tagging position to join the fed tag to the selected layers of the article in said tagging position.

2. An apparatus as in claim 1, said clamp means and table being relatively movable to clamp the selected layers of an article therebetween in said tagging position.

3. An apparatus as in claim 2, said clamp means having a surface on which the selected layers of an article are placed and having walls bordering said opening therein shielding the remaining layers of the article from contact with said tack feeding means when the tack feeding means and tack are received therein and move thereinto.

4. An apparatus as in claim 1, said tack feeding means being a needle movable between a position wherein the same is free of tacks and a position wherein the same receives a new tack from said tack supply and feeds the same through said tagging position, and said tack supply being a plurality of interconnected tacks supported on said apparatus for receipt of an end-most one of said tacks by said tack feeding means.

5. An apparatus as in claim 1, said supply of tags being on said table and including means adjustable to accommodate tags of different sizes and including said tag feed means to feed at least one tag at a time from said supply of tags to said tagging position.

6. An apparatus as in claim 1, said means feeding said tag portion to said tagging position moves the fed tag such that a portion of the feed tag remains in said tag supply.

7. An appartus for automatically tagging a selected layer of a layered article comprising a table having a tagging position, a clamp, said table and clamp being normally relatively spaced to receive the selected layer of a layered article therebetween in said tagging position, means to locate the selected layer in said tagging position below said table and between said table and said clamp, a supply of tags having means to feed a tag therefrom to said tagging position on said table, means to feed a tack to said tagging position and through said tag in said tagging position, and means operable automatically to move said table and said clamp relative to each other to clamp the selected layer of the layered article therebetween and spaced by said table from said tag in said tagging position, and to feed a tag to said tagging position, and to feed a tack to said tagging position and at least partially through said tag and said selected layer in said tagging position to thereby join said tag to the selected layer.

8. In an automatic tagging apparatus as in claim 7, said table being stationary and said clamp being movable relative to the table to clamp the selected layer therebetween, and said relative space between said clamp and layer being at the front thereof to enable the selected layer of the article to be inserted into said apparatus through the front thereof and to be removed therefrom at the front thereof.

9. In an automatic tagging apparatus as in claim 7, said operable means automatically releasing said clamp to release the selected layer and returning said table and clamp to their normally relatively spaced positions and moving said tag feed means to a position to feed a new tag to said tagging position, and moving said tack feed means to a position to receive a new tack to feed to said tagging position.

10. In an automatic tagging apparatus as in claim 9, said operable means including means to adjust the relative times of operation of said clamp, tag feed means and tack feed means and the duration of their respective operations.

11. In an automatic tagging apparatus as in claim 10, a continuous supply of tacks interconnected with and separable from each other on said apparatus with the leading one of said supply of tacks received by said tack feed means when said tack feed means is moved to said tack receiving position.

12. In an automatic tagging apparatus as in claim 7, said clamp being movable in response to the operation of said operable means to clamp the selected layer beneath said table.

13. In an automatic tagging apparatus as in claim 12, said clamp having shielding means about said opening therein to enclose and avoid contact between said tack feed means and the layers of the article other than with the selected layer.

14. The method of joining a tag to selected layers of a layered article by a tack comprising placing selected layers of the layered article to a locating means and adjacent an anvil having a desired portion thereof positioned in line with a tack feeding needle, moving the anvil to clamp the selected layers at the desired portion between the anvil and below a table, feeding a tag onto the table from a tag supply with the tag having a desired portion positioned in line with the tack feeding needle, and moving the needle to feed a tack through the table and the desired portion of the tag and through the selected layers and into the anvil to join the tag to said selected layers, and removing the joined tack, tag and selected layers by way of a slot in the table.

15. The method as in claim 14, moving the anvil to unclamp the selected layers after the tag is joined thereto by the tack, and removing the article and joining tack from between the anvil and table.

16. The method as in claim 14, wherein the step of moving the tack feeding needle through the tag and the selected layers further comprises feeding the tack through the tag and the selected layers.

17. The method as in claim 16, shielding the tack feeding needle for contact with only the desired portion of the article and from contact with other portions of the article as the tack feeding needle moves through the selected layers.

18. The method as in claim 17, moving the tack feeding needle to receive a tack supplied to the same while feeding another tack to a position to supply the same to the needle while removing the article from between the anvil and table.

19. The method as in claim 14, placing the selected layers on the anvil and below the table, and feeding the tag on the table above the desired portion of the selected layers and below the tack feeding needle.

20. The method as in claim 14, retaining a portion of the fed tag in the tag supply while the desired portion thereof is in line with the tack feeding needle.

* * * * *